US008840306B1

(12) United States Patent
Poel et al.

(10) Patent No.: US 8,840,306 B1
(45) Date of Patent: Sep. 23, 2014

(54) CHEMICAL ODOR TRAPPING BAG

(71) Applicant: Gonzo Bags Corp., Eureka, CA (US)

(72) Inventors: Jeffrey D. Poel, Eureka, CA (US); Brandon V. Roberts, Anthem, AZ (US)

(73) Assignee: Gonzo Bags Corp., Eureka, CA (US)

( * ) Notice: Subject to any disclaimer, the term of this patent is extended or adjusted under 35 U.S.C. 154(b) by 0 days.

(21) Appl. No.: 13/743,284

(22) Filed: Jan. 16, 2013

Related U.S. Application Data

(60) Provisional application No. 61/588,157, filed on Jan. 18, 2012.

(51) Int. Cl.

| | |
|---|---|
| ***B65D 33/30*** | (2006.01) |
| ***B65D 33/16*** | (2006.01) |
| ***B65D 33/00*** | (2006.01) |
| ***B65D 30/08*** | (2006.01) |

(52) U.S. Cl.
CPC ..... *B65D 33/00* (2013.01)
USPC ..... 383/89; 383/61.1; 383/93; 383/105; 383/109

(58) Field of Classification Search
CPC ..... B65F 1/0006; B65F 7/00
USPC ..... 383/85, 86, 88, 89, 61.1, 93, 98, 99, 383/105, 109
See application file for complete search history.

(56) References Cited

U.S. PATENT DOCUMENTS

| | | | | |
|---|---|---|---|---|
| 5,078,508 | A * | 1/1992 | Johan et al. | 383/75 |
| 5,174,462 | A * | 12/1992 | Hames | 220/87.1 |
| 5,585,107 | A * | 12/1996 | Vickers | 424/402 |
| 5,996,799 | A * | 12/1999 | Garreth et al. | 206/521 |
| 6,073,772 | A * | 6/2000 | Forbes et al. | 206/527 |
| 6,561,355 | B1 * | 5/2003 | Forbes et al. | 206/527 |
| 7,387,205 | B1 * | 6/2008 | Wilson | 206/524.4 |
| 2003/0078552 | A1 * | 4/2003 | Tepper et al. | 604/333 |
| 2004/0134923 | A1 * | 7/2004 | Aquino et al. | 220/912 |
| 2006/0005838 | A1 * | 1/2006 | Magidson | 128/206.19 |
| 2009/0266910 | A1 * | 10/2009 | Hunter | 239/57 |
| 2012/0301057 | A1 * | 11/2012 | Conant et al. | 383/64 |

FOREIGN PATENT DOCUMENTS

| | | | | |
|---|---|---|---|---|
| JP | 02085182 | A * | 3/1990 | B65D 81/24 |

OTHER PUBLICATIONS

Deodorizer Bag, product web pages, http://deodorizerbag.com/about/history/ and http://deodorizerbag.com/about/how-it-works/, four pages, product available since 2009.

Product details for polyurethane foam activated carbon filter material, Alibaba.com web page, http://www.alibaba.com/product-detail/Activated-carbon-air-filter-foam_938911380.html, one page, product available since at least Jan. 17, 2012.

* cited by examiner

*Primary Examiner* — Jes F Pascua
(74) *Attorney, Agent, or Firm* — Donald J. Pagel

(57) ABSTRACT

A container comprised of an inner bag having a chamber for holding an item and a top through which the item can be placed in the chamber; an odor containment section attached to the inner bag; an odor containment flap positioned inside of the inner bag and adapted to be folded over the item when the item is held in the chamber of the inner bag; and an outer bag that surrounds the inner bag and the odor containment section, with the top of the inner bag extending beyond a top of the outer bag. Generally, the container is used to contain or minimize the odors emitted by organic materials such as, food, plant matter, or feces.

12 Claims, 3 Drawing Sheets

CHEMICAL ODOR TRAPPING BAG

This application claims the benefit of U.S. provisional patent application 61/588,157, filed Jan. 18, 2012, which is incorporated herein by reference.

BACKGROUND OF THE INVENTION

There are numerous situations where it is desirable to contain or minimize the odors emitted by odorous or odoriferous, organic materials. Examples of such materials include food, plant matter, and feces. Situations where such odor containment or minimization is needed include, for example, the transportation and/or storage of items such as food supplies for wilderness campers, plant products, such as marijuana, used dog feces collection bags, dirty diapers from human babies, and other types of odorous or odoriferous materials. What is needed is a simple and effective container for holding items of this nature that can contain or minimize the emitted odors.

BRIEF SUMMARY OF THE INVENTION

Briefly, the present invention comprises an odor containment bag that can contain odors emitted by an item stored in the bag. The odor containment bag comprises an inner bag having a chamber for holding the item and an odor containment section attached to an outside surface of the inner bag. An outer bag surrounds the inner bag and the odor containment section with the top of the inner bag extending beyond the top of the outer bag. An odor containment flap attached to the inner bag folds over the item stored in the bag, and attachment means attached to the inner and/or outer bags allows the top of the inner bag to be closed in an odor-tight manner. The inner and outer bags may be comprised of polyethylene and the odor containment section and the odor containment flap may comprise activated carbon.

DETAILED DESCRIPTION OF THE INVENTION

Figure 1:
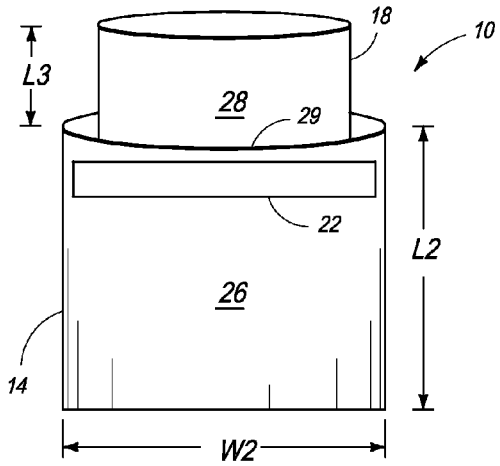
FIG. 1 is a front isometric view of an odor trapping bag according to the present invention.

FIG. 1 illustrates an odor trapping bag 10 comprised of an outer bag 14 and an inner bag 18. A front attachment means 22 is positioned on the front side 26 of the outer bag 14 near the top of the outer bag 14. The inner bag 18 is sized to fit inside the outer bag 14. In a preferred embodiment, this is accomplished by choosing a width "W1" (shown in FIG. 2) for the inner bag that is less than a width "W2" of the outer bag 14. Also, in a preferred embodiment, the outer bag 14 has a length "L2" that is less than a length "L1" (shown in FIG. 2) of the inner bag 18.

Because the length "L2" is less than the length "L1," the inner bag 18 extends above the top of the outer bag 14 by a length "L3." The part of the inner bag 18 that extends above the top of the outer bag 14 is referred to as the roll top section 28. The top part of the outer bag 14 that is adjacent to the inner bag 18 is referred to as the front attachment site 29. The front attachment site 29 extends along the width "W2" of the outer bag 14.

Figure 2:
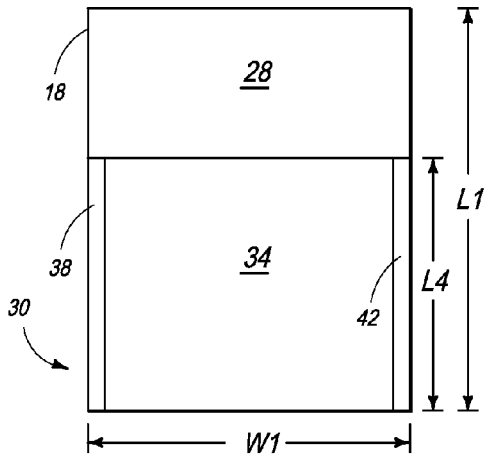
FIG. 2 is a front view of an inner bag of the odor trapping bag according to the present invention.

FIG. 2 illustrates that the inner bag 18 has an odor containment section 30 positioned adjacent to an outside surface of the inner bag 18. In a preferred embodiment, the odor containment section 30 comprises a front panel 34, a first side panel 38, a second side panel 42, and a back panel 46 (shown in FIG. 5). In a preferred embodiment, the front panel 34, the back panel 46, the first side panel 38, the second side panel 42 and a flap panel 48 (shown in FIG. 3) each comprise an odor adsorbing material. The flap panel 48 is an optional feature that can be omitted in other embodiments. The odor trapping section 30, comprised of the panels 34, 46, 38 and 42, provides a region in which an outer section of the inner bag 18 is completely surrounded by odor adsorbing material on the front, back and side sections of part of the inner bag 18. Preferably, the odor containment section 30 is attached to the outside of the inner bag 18 below the roll top section 28 and has a length "L4." The flap panel 48 provides a region of odor adsorbing material on the top inside part of the inner bag 18.

In a preferred embodiment, the outer bag 14, the inner bag 18 and a flap bag 50 (shown in FIG. 3) are each comprised of a bag comprised of a durable synthetic material, such as polyethylene. Polypropylene could also be used as the durable synthetic material. In a preferred embodiment, the odor adsorbing material used in the odor containment section 30, including the flap panel 48, is comprised of carbon. More preferably, the odor adsorbing material comprises activated carbon, and most preferably the odor adsorbing material comprises activated carbon mixed with, or impregnated with, an inert material. The odor adsorbing material may have an activated carbon concentration of approximately thirty grams of carbon per square foot of material (30 g/ft$^2$). In other embodiments, other types of odor adsorbing and/or absorbing materials may be used in the odor containment section 30 such as zeolites (aluminosilicates) and other types of molecular sieves, as well as other types of synthetic and naturally occurring odor adsorbing and/or absorbing materials.

A suitable odor adsorbing material for use in the odor containment section 30 is a filter material impregnated with activated carbon, such as the material that is commercially available from a source like Guangzhou Fresh Air Clean & Filtration Product Co., Ltd. of Guangdong, China, under the product designation FRS-ACF carbon foam. This material is a sponge-like material comprised of polyurethane foam and activated carbon, with a 60-70% activated carbon content. Polyethylene bags suitable for use as the outer bag 14, the inner bag 18 and the flap bag 50 are commercially available from sources such as Four Star Plastics of Beltsville, Md., under the product designation 101324400.

Figure 3:
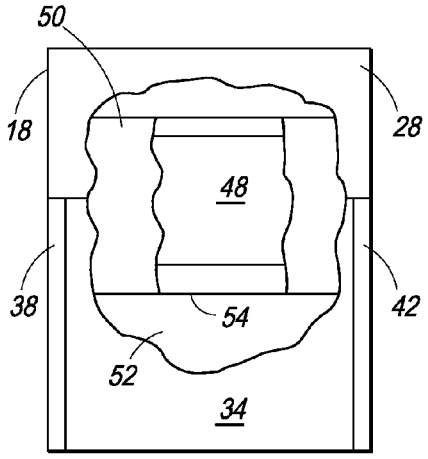
FIG. 3 is a front view of the inner bag of the odor trapping bag with a cut-away section showing the top panel according to the present invention.

FIG. 3 illustrates that in a preferred embodiment the odor trapping bag 10 includes a flap panel 48. Preferably, the flap panel 48 is comprised of the odor adsorbing material described previously. Preferably, the flap panel 48 comprises a piece of inert material impregnated with activated carbon that is sealed inside of the flap bag 50, such as a polyethylene bag. The flap bag 50 is sized to fit inside of the inner bag 18 and is attached to an inside back wall 52 of the inner bag 18 along an attachment site 54.

Preferably, the attachment site 54 stretches along the complete width of the flap bag 50 in the direction of the width W1 and is below the roll top section 28. The flap bag 50 forms an odor containment flap that can be folded over the top of an item 56 (shown in FIG. 6) placed inside of the inner bag 18. After the flap bag 50 has been folded over the item placed in the inner bag 18, the roll top section 28 is rolled down and secured to the outer bag 14 along the front attachment means 22. The attachment of the flap bag 50 is shown in more detail in FIG. 6.

Figure 4:
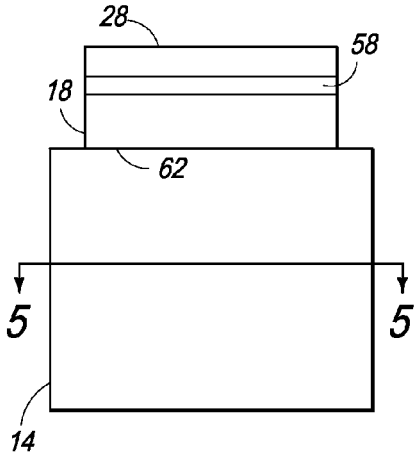
FIG. 4 is a back view of an odor trapping bag according to the present invention.
Figure 8:
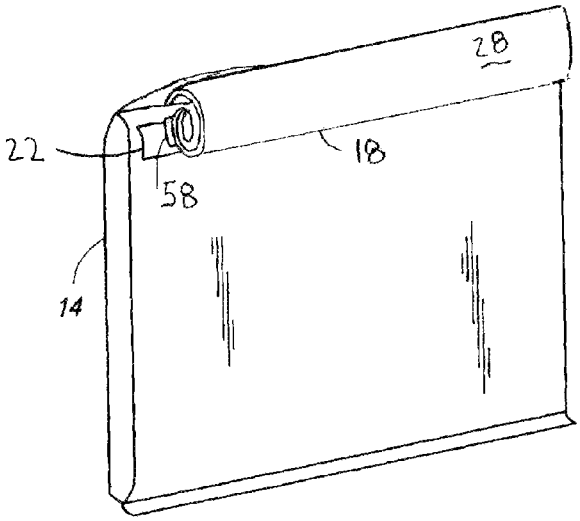
FIG. 8 is an isometric view of a closed odor trapping bag according to the present invention.

FIG. 4 shows the back side of the odor trapping bag 10 and illustrates that in a preferred embodiment, a back attachment means 58 is attached to the outside of the inner bag 18 on the back side of the inner bag 18. Preferably, the back attachment means 58 is attached to the roll top section 28 section of the inner bag 18 so that when the roll top section 28 is rolled up, the back attachment means 58 meets up with the front attachment means 22 as is shown in FIG. 8. The top part of the outer bag 14 that is adjacent to the back of the inner bag 18 is referred to as the back attachment site 62. The back attachment site 62 extends along the width "W2" of the outer bag 14 on the back side of the outer bag 14.

In a preferred embodiment, the front attachment means 22 and the back attachment means 58 are comprised of complementary materials that allow the odor trapping bag 10 to be closed or sealed in a manner that prevents odors from escaping from the odor trapping bag 10. In a preferred embodiment, the front attachment means 22 and the back attachment means 58 are comprised of a hook and loop material, such as a Velcro™ brand hook and loop material. However, other types of fasteners can be used such as chemical adhesives (e.g. glues), snaps, zip lock seals, Dual Lock™ reclosable fasteners and the like. In general terms, the function of the attachment means 22 and 58 is to provide a means for closing the top of the inner bag 18.

Figure 5:
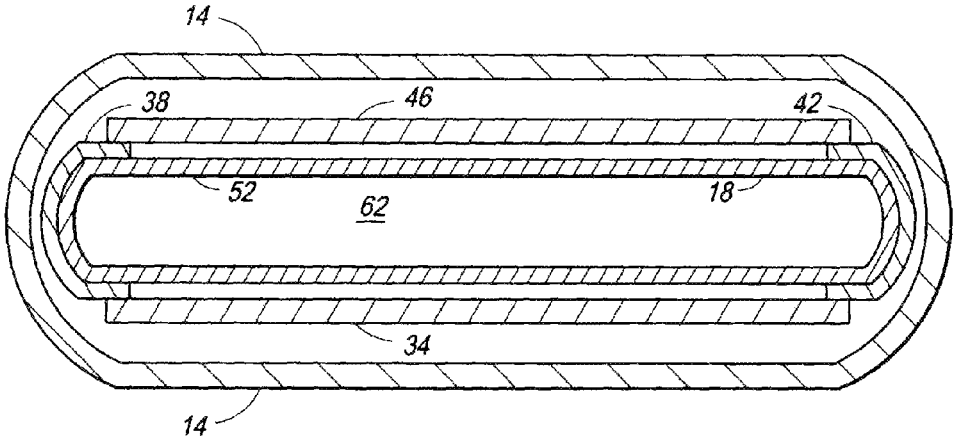
FIG. 5 is a cross-sectional view of the odor trapping bag taken along the line 5-5 shown in FIG. 4.

FIG. 5 is cross-sectional view of the odor trapping bag 10 illustrating the orientation of the front panel 34, the back panel 46, the first side panel 38 and the second side panel 42 with the outer bag 14 and the inner bag 18. The first side panel 38 and the second side panel are attached to the sides of the inner bag 18 with an adhesive material such as glue. The first side panel 38 and the second side panel 42 are each long enough to extend down the length "L4" of the odor containment section 30 and wrap around the sides of the inner bag 18 so that a portion of the first side panel 38 and the second side panel 42 extends along the front and back sides of the inner bag 18 along the length "L4."

The front panel 34 is attached adjacent to the front of the inner bag 18, such as by using an adhesive, such as glue, to attach the front panel 34 to the portions of the first side panel 38 and the second side panel 42 that extend along the front side of the inner bag 18 along the length "L4." Similarly, the back panel 46 is attached adjacent to the back of the inner bag 18, such as by using an adhesive, such as glue, to attach the back panel 46 to the portions of the first side panel 38 and the second side panel 42 that extend along the back side of the inner bag 18 along the length "L4." The front panel 34 and the back panel 46 extend all the way down to the bottom of the inner bag 18 and are attached to the bottom of the inner bag 18 along the width "W1" using an adhesive such as glue. The front panel 34 and the back panel 46 extend upward on the inner bag 18 to a location adjacent to the approximate bottom of the attachment means 22 and are attached to the top of the inner bag 18 along the width "W1" using an adhesive such as glue.

The inner bag 18 fits inside of the outer bag 14 and is attached to the outer bag 14 along the front attachment site 29 and along the back attachment site 62, such as by using an impulse heat sealer. Because the front attachment site 29 and the back attachment site 62 extend along the whole width W2, and since the width W2 is greater than the width W1, the edges of the outer bag 14 are attached (sealed) to each other where the front attachment site 29 and the back attachment site 62 meet up. Preferably, the odor containment section 30 is positioned below the attachment sites 29 and 62.

The flap bag 50 is attached to the inside back surface of the inner bag 18 along the attachment site 54 by a suitable attachment means, such as glue or another method of attachment. The front attachment means 22 is attached to the front side 26 of the outer bag 14 as shown in FIG. 1 and the back attachment means 58 is attached to the outside of the inner bag 18 on the back side of the inner bag 18 as shown in FIG. 4.

In a preferred embodiment, the front attachment means 22 comprises the loop part of a hook and loop fastener, while the back attachment means 58 comprises the hook part of the hook and loop fastener. In other embodiments, other configurations and other fasteners can be used. The space between the inside walls of the inner bag 18 creates a chamber 62. When the odor trapping bag 10 is being used, the item 56 is placed in the chamber 62.

Figure 6:
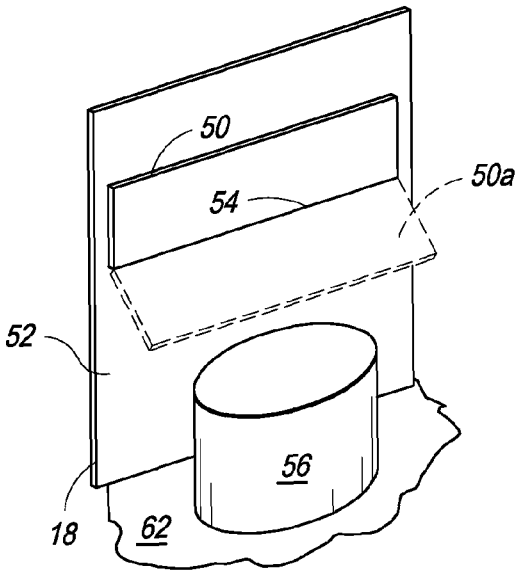
FIG. 6 is an isometric view of part of the inner bag according to the present invention.

FIG. 6 illustrates that the flap bag 50 is attached to the inside of the back wall 52 of the inner bag 18 along the attachment site 54. The attachment site 54 allows the flap bag 50 to be folded downward (as indicated by the phantom flap bag 50*a*) so as to cover the item 56 that is positioned in the chamber 62. Generally, the item 56 is an odor-emitting material such as food, plant matter, feces, or other types of odorous or odoriferous materials.

Figure 7:
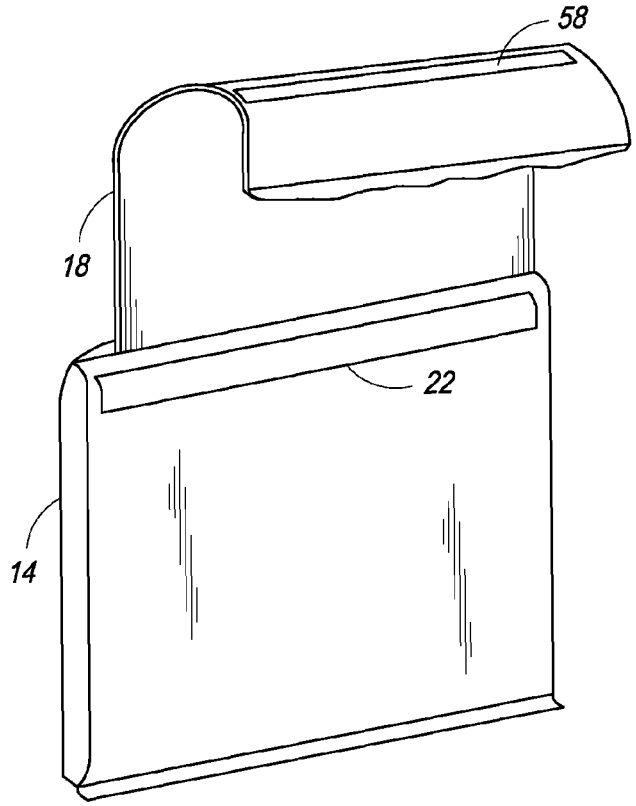
FIG. 7 is an isometric view of an open odor trapping bag according to the present invention.

FIG. 7 illustrates that the inner bag 18 extends outside of the outer bag 14 and that there is an opening in the top of the inner bag 18 for allowing the item 56 to be placed in the chamber 62. The back attachment means 58 is positioned on the inner bag 18 so that it can be used to close the inner bag 18 when desired as illustrated in FIG. 8. FIG. 8 illustrates that the roll top section 28 of the inner bag 18 can be rolled up until the back attachment means 58 is adjacent to the front attachment means 22, so that the attachment means 58 and 22 can be pressed together to close the odor trapping bag 10 by closing the top of the inner bag 18. Preferably, the closing of the top of the inner bag 18 holds odors emitted by the item 56 inside of the odor trapping bag 10, where the odors are adsorbed by the odor containment section 30.

In the preferred embodiment, the outer bag 14 is a pouch-like bag that has a rectangular shape. The outer bag 14 is comprised of a front part and a back part with a space formed between the front part and the back part. The front part and the back part each have a thickness. For example, the thickness of the front part can be approximately 4 mil (one mil is equal to one thousandth of an inch (0.0254 millimeter) and the thickness of the back part can be approximately 4 mil. The outer bag 14 is closed/sealed along three sides (i.e., along the bottom, and along the two edges having the length L2). The outer bag 14 is sealed along three sides (i.e., along the bottom, and along the two sides having the length L2). The top of the outer bag 14 is initially open (unsealed) so that the inner bag 18 can be inserted into the space formed between the front part and the back part. Eventually, after the insertion of the inner bag 18, the top of the outer bag 14 is sealed to the front and back sides of the inner bag 18 to keep the outer bag 14 and the inner bag 18 attached to each other as well as to trap odors between the two bags. The front attachment site 29 (shown in FIG. 1) and the back attachment site 62 indicate where the inner bag 18 is sealed to the outer bag 14 and also indicate the top of the outer bag 14.

In the preferred embodiment, the inner bag 18 is also a pouch-like bag that has a rectangular shape. The inner bag 18 is comprised of a front part and a back part with the chamber 62 being the space (void) that is formed between the front part and the back part. The inner bag 18 is closed/sealed along three sides (i.e., along the bottom, and along the two edges having the length L1). The top of the inner bag 18 is initially open (unsealed) so that the item 56 can be inserted into the chamber 62. The top of the inner bag 18 is the top part of the roll top section 28 illustrated in FIG. 1 as being open. A representative example for constructing a preferred embodiment of the bag 10 is given below in Example 1.

EXAMPLE 1

The dimensions and materials used in this example are representative of this embodiment, but other dimensions and materials can be used.

a) The inner bag 18 consists of a commercially available polyethylene plastic bag, approximately 4 mil thick, and approximately thirty-six inches long by twelve inches wide (i.e., W1=12 inches; L1=36 inches).

b) Two pieces of commercially available, activated carbon impregnated filter media (i.e. the side panels 38 and 42) impregnated with approximately 30 grams/square foot of activated charcoal, approximately three inches wide and twelve inches long by ⅛ inch thick, are bonded (using a glue gun) to the front and the back of the inner bag, so that the side margins of the inner bag 18 have approximately 1.5 inches of filter media running the length of the bag on each side.

c) One piece of commercially available activated carbon impregnated filter media (i.e., the front panel 34), approximately ¼-inch thick and twelve inches wide by twenty-two inches long (i.e., L4=22 inches), is then glued to the side filters on the front of the inner bag 18, flush with the heat welded bottom and side margins of the inner bag 18, using a glue gun. The back panel 46 is formed by gluing a second piece of the filter material (having similar dimensions as the front panel 34) to the side filters on the back of the inner bag 18, flush with the heat welded bottom and side margins of the inner bag 18, using a glue gun. Preferably, activated carbon impregnated filter media described above material is a material comprised of polyurethane foam and activated carbon.

d) The inner bag 18 and filter media (i.e., the panels 34, 38, 42 and 46) are then inserted into the outer bag 14, which is an approximately 4 mil thick, commercially available polyethylene plastic bag, approximately thirteen inches wide by twenty-four inches long (i.e., W2=13 inches; L2=24 inches).

e) The top of the outer bag 14 is then heat welded to the inner bag 18 on both the front and back sides using a commercially available impulse heat sealer.

f) A piece of filter media (i.e. the flap panel 48) covered with a 4 mil thick polyethylene plastic bag (i.e. the flap bag 50), approximately 11.8 inches wide by six inches long is then glued to the inside of the back wall of the inner bag 18 along the attachment site 54 using a glue gun, so that it forms a flap that can be folded over the top of any material stored inside the bag 18. This flap is intended to absorb and trap volatile or semi-volatile organic chemicals emitted from the stored material so that they cannot migrate past the flap to the open end of the bag 18.

g) A one-inch wide by twelve inch long, commercially available Velcro® strip is then glued to the top outside surface of the inner bag 18, approximately two inches from the top heat weld (i.e., above the back attachment site 62) to form the back attachment means 58. Its Velcro® mate is glued to the front outside surface of the outer bag 14 approximately flush with the heat weld (i.e., flush with the front attachment site 29) to form the front attachment means 22. Thus, the roll top section 28 of the inner bag 18 can be rolled from the top and held in place using the Velcro® brand fasteners (i.e., the attachment means 22 and 58) so that the roll top section 28 impedes migration of volatile and semi-volatile organic compounds past the filter media flap (flap bag 50), effectively trapping odors inside the odor trapping bag 10.

h) The odor trapping bag 10 is reusable. The roll down top (roll top section 28) can be rolled and unrolled using the Velcro® brand fasteners many times.

The odor trapping bag 10 is used to store an odorous or odoriferous material, such as food, feces, or plant matter (e.g. marijuana). The size of the bag 10 can be adjusted depending on the use to accommodate different weights and/or volumes of material. For example, it is found that a bag 10 that is 13 inches by 24 inches on the outside might hold an item (i.e., the item 56) up to two pounds in weight, while a bag 10 that is 8 inches by 11 inches on the outside might hold an item up to one quarter of a pound in weight. The odor trapping bag 10 is designed to trap all organic chemical odors that leak or diffuse through the inner, polyethylene plastic bag using a layer of activated charcoal filter media that is placed between the inner bag and the outer bag. Applications include bear proofing food for wilderness campers, temporary storage of used dog feces collection bags while transporting to a suitable disposal site, temporary storage of dirty diapers from human babies, and other applications of this type.

In one embodiment, the odor trapping bag 10 comprises an inner bag 18 having a chamber 62 for holding an item 56 and a top 28 through which the item can be placed in the chamber; an odor containment section 30 attached to the inner bag; and an outer bag 14 that surrounds the inner bag and the odor containment section, with the top 28 of the inner bag extending beyond a top 29 of the outer bag. The odor trapping bag 10 may also include an odor containment flap 48 positioned inside of the inner bag and adapted to be folded over the item when the item is held in the chamber of the inner bag.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true scope of the invention.

We claim:

1. A container comprising:

an inner bag consisting essentially of plastic and having a chamber for holding an item, an outer surface that is not part of the chamber, an inside surface that forms the chamber, a roll top section and an inner bag top through which the item can be placed in the chamber, the inner bag top comprising an end of the roll top section;

an odor containment section comprised of activated carbon and positioned adjacent to the outer surface of the inner bag;

an outer bag consisting essentially of plastic, the outer bag surrounding the odor containment section and forming at least part of the outside of the container, with the roll top section of the inner bag extending beyond the odor containment section and a top of the outer bag so that the roll top section can be rolled up to have a cylinder-like configuration, and with the odor containment section being positioned between the outer surface of the inner bag and the outer bag; and attachment means for closing the inner bag after the roll top section has been rolled up.

2. The container of claim 1 wherein the plastic in the inner bag is selected from the group consisting of polyethylene and polypropylene.

3. The container of claim 2 wherein the inner bag has a thickness of approximately 4 mil.

4. The container of claim 1 wherein the plastic in the outer bag is selected from the group consisting of polyethylene and polypropylene.

5. The container of claim 4 wherein the outer bag has a thickness of approximately 4 mil.

6. The container of claim 1 wherein the odor containment section comprises one or more panels comprised of activated carbon and polyurethane.

7. The container of claim 6 wherein the one or more panels comprise a front panel and a back panel attached to the front and back of the inner bag, respectively, and a first side panel attached along an edge of the inner bag and a second side panel attached along another edge of the inner bag.

8. The container of claim 1 further comprising an odor containment flap attached to an inside surface of the inner bag.

9. The container of claim 8 wherein the odor containment flap comprises activated carbon and polyurethane contained inside of a flap bag, the flap bag being attached to the inside surface of the inner bag.

10. The container of claim 1 wherein the attachment means comprises a hook and loop fastener.

11. The container of claim 10 wherein the hook and loop fastener comprises a back piece and a front piece, with the back piece comprising a first part of the hook and loop fastener attached to the roll top section of the inner bag, and the front piece comprising a second part of the hook and loop fastener attached to the outer bag, with the roll top section adapted to be rolled up so that the back piece can be attached to the front apiece, thereby closing the inner bag.

12. The container of claim 1 wherein the top of the outer bag is sealed to the inner bag along an attachment site, with the odor containment section being positioned below the attachment site.

* * * * *